US008299720B2

(12) United States Patent
Luo

(10) Patent No.: US 8,299,720 B2
(45) Date of Patent: Oct. 30, 2012

(54) OPERATING RESONANT LOAD CIRCUIT, DIMMING CIRCUIT AND DIMMING METHOD

(75) Inventor: Zhigang Luo, Foshan (CN)

(73) Assignee: Osram Sylvania Inc., Danvers, MA (US)

( * ) Notice: Subject to any disclaimer, the term of this patent is extended or adjusted under 35 U.S.C. 154(b) by 390 days.

(21) Appl. No.: 12/703,542

(22) Filed: Feb. 10, 2010

(65) Prior Publication Data

US 2010/0302821 A1 Dec. 2, 2010

(30) Foreign Application Priority Data

May 27, 2009 (CN) ..... 2009 1 0145220

(51) Int. Cl.
*H05B 37/02* (2006.01)

(52) U.S. Cl. ..... 315/209 R; 315/224; 315/291

(58) Field of Classification Search ..... 315/209 R, 315/224–226, 246, 283, 288, 291, 307, 308, 315/DIG. 4, DIG. 5, DIG. 7
See application file for complete search history.

(56) References Cited

U.S. PATENT DOCUMENTS

| | | | | |
|---|---|---|---|---|
| 5,349,270 | A * | 9/1994 | Roll et al. | 315/209 R |
| 5,866,993 | A * | 2/1999 | Moisin | 315/307 |
| 5,872,429 | A * | 2/1999 | Xia et al. | 315/194 |
| 6,181,075 | B1 * | 1/2001 | Doss | 315/224 |
| 7,755,304 | B2 * | 7/2010 | Green | 315/308 |

* cited by examiner

*Primary Examiner* — Tung X Le
(74) *Attorney, Agent, or Firm* — Shaun P. Montana

(57) ABSTRACT

An operating resonant load circuit, a dimming circuit and a dimming method are disclosed. The operating resonant load circuit includes: an input unit including a plurality of input terminals, for receiving an AC voltage; a rectifier, for transforming the AC voltage received by the input unit into a DC bus voltage; and a controller, for dividing the DC bus voltage based on an conducting status of the input terminals to output a corresponding DC reference voltage. The dimming circuit and dimming method use the operating resonant load circuit to perform dimming.

17 Claims, 5 Drawing Sheets

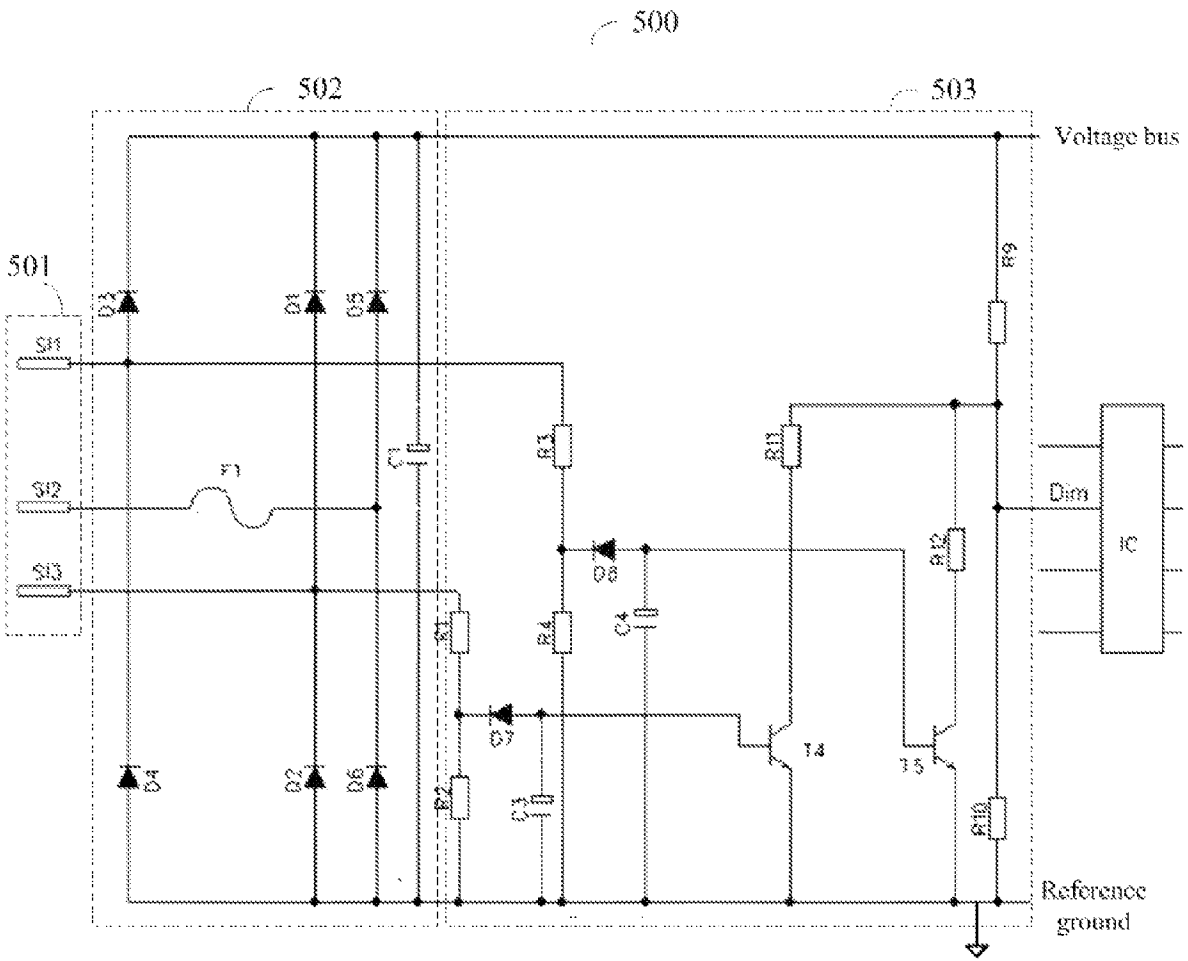
500
501
502
503
Voltage bus
Reference ground
IC
Dim
R9
R10
R11
R12
R13
R14
R15
R16
R17
R18
R19
R20
R21
R22
R23
R24
C1
C2
C3
C4
D1
D2
D3
D4
D5
D6
D7
D8
D9
D10
D11
D12
D13
D14
D15
D16
D17
D18
D19
D20
D21
D22
D23
D24
D25
D26
D27
D28
D29
D30
D31
D32
D33
D34
D35
D36
D37
D38
D39
D40

OPERATING RESONANT LOAD CIRCUIT, DIMMING CIRCUIT AND DIMMING METHOD

CROSS-REFERENCE TO RELATED APPLICATIONS

This application claims priority to Chinese Patent Application No. 200910145220.2, filed on May 27, 2009, which is incorporated herein by reference in its entirety.

TECHNICAL FIELD

The present invention generally relates to a circuit for operating a load, in particular to an operating resonant load circuit, a dimming circuit and a dimming method.

BACKGROUND

In the conventional art, in cooperation with a traditional three way switch, a ballast circuit of a fluorescent lamp can adjust the light output of the fluorescent lamp and provide three discrete levels of light intensity.

U.S. Pat. No. 5,821,699 discloses a three level dimming ballast for a fluorescent lamp. The U.S. patent adapts a bridge rectifier to obtain a first power level for the fluorescent lamp, adapts a double voltage rectifier to obtain a second power level for the fluorescent lamp, and adapts a double voltage rectifier and changes the operating frequency of the ballast to obtain a third power level for the fluorescent lamp.

However, for the first power level, the above described ballast may have a problem of startup under lower temperatures, low voltages and low power levels. Moreover, such a ballast is not suitable to use with a 230V Alternating Current (AC) input voltage.

SUMMARY

An object of the invention is to provide an operating resonant load circuit, a dimming circuit and a dimming method. The circuits and the method can produce a changeable Direct Current (DC) reference voltage by setting a three way switch, so as to change an output driving signal of a power driving apparatus.

According to an aspect of the invention, an operating resonant load circuit is provided. The operating resonant load circuit includes: an input unit including a plurality of input terminals for receiving an AC voltage; a rectifier for transforming the AC voltage received by the input unit into a DC bus voltage; and a controller for dividing the DC bus voltage based on an conducting status of the input terminals to output a corresponding DC reference voltage.

Preferably, the controller includes: a first voltage network, connected between a voltage bus and a reference ground of the circuit; a first control branch, including a second voltage network connected between a first input terminal of the input unit and the reference ground, and a first resistor and a first transistor connected in series between an intermediate node of the first voltage network and the reference ground, a base of the first transistor being connected to an intermediate node of the second voltage network; and a second control branch, including a third voltage network connected between a second input terminal of the input unit and the reference ground, and a second resistor and a second transistor connected in series between an intermediate node of the first voltage network and the reference ground, a base of the second transistor being connected to an intermediate node of the third voltage network.

Preferably, the first control branch of the controller further includes a third resistor and a third transistor connected in series between the voltage bus and the reference ground, the base of the first transistor being connected to a collector of the third transistor instead of the base of the first transistor being connected to an intermediate node of the second voltage network, and a base of the third transistor being connected to an intermediate node of the second voltage network; and the second control branch of the controller further includes a fourth resistor and a fourth transistor connected in series between the voltage bus and the reference ground, the base of the second transistor being connected to a collector of the fourth transistor instead of the base of the second transistor being connected to an intermediate node of the third voltage network, and a base of the third transistor being connected to an intermediate node of the third voltage network.

Preferably, the rectifier is connected between the voltage bus of the circuit and the reference ground.

Preferably, the rectifier includes: a first diode and a second diode connected in series in the same direction between the voltage bus and the reference ground; a third diode and a fourth diode connected in series in the same direction between the voltage bus and the reference ground; and a first capacitor and a second capacitor connected in series in the same direction between the voltage bus and the reference ground, wherein the pair of the first diode and the second diode, the pair of the third diode and the fourth diode, and the pair of the first capacitor and the second capacitor are connected in parallel.

Preferably, the rectifier includes: a first diode and a second diode connected in series in the same direction between the voltage bus and the reference ground; a third diode and a fourth diode connected in series in the same direction between the voltage bus and the reference ground; a fifth diode and a sixth diode connected in series in the same direction between the voltage bus and the reference ground; and a first capacitor connected between the voltage bus and the reference ground, wherein the pair of the first diode and the second diode, the pair of the third diode and the fourth diode, and the pair of the fifth diode and the sixth diode are connected in parallel.

According to another aspect of the invention, a dimming circuit is provided. The dimming circuit includes: the above operating resonant load circuit; and a power driving apparatus for receiving a DC reference voltage from the operating resonant load circuit and outputting a driving signal of a corresponding frequency based on the received DC reference voltage.

According to another aspect of the invention, a dimming method adapted to be used in the above dimming circuit is provided. The dimming method includes: sensing an input voltage of the input unit; determining whether the input voltage is provided at the first input terminal, the second terminal, or both the input terminals of the input unit; generating by the operating resonant circuit a first DC reference voltage in response to the input voltage, if the input voltage is provided only at the first input terminal; generating by the operating resonant circuit a second DC reference voltage in response to the input voltage, if the input voltage is provided only at the second input terminal; generating by the operating resonant circuit a third DC reference voltage in response to the input voltage, if the input voltage is provided at both the input terminals; and applying the first DC reference voltage, the second DC reference voltage or the third DC reference voltage to the power driving apparatus, so as to output a corresponding power level.

The circuits according to embodiments of the invention can cooperate with a three way switch to adjust the light output of a lamp to three discrete levels corresponding to three settings of the three way switch. The circuits according to the embodiments of the invention can provide a stable bus voltage and change the DC reference voltage applied to the power driving apparatus, so that the power driving apparatus can output a driving signal of a corresponding frequency. In practice, driving signals of different frequencies can change the operating frequency of a ballast, therefore the dimming function is realized and the load can work under three discrete power levels.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

FIG. 5 illustrates a circuit diagram of an operating resonant load circuit according to a fourth embodiment of the invention.

DETAILED DESCRIPTION

Figure 1:
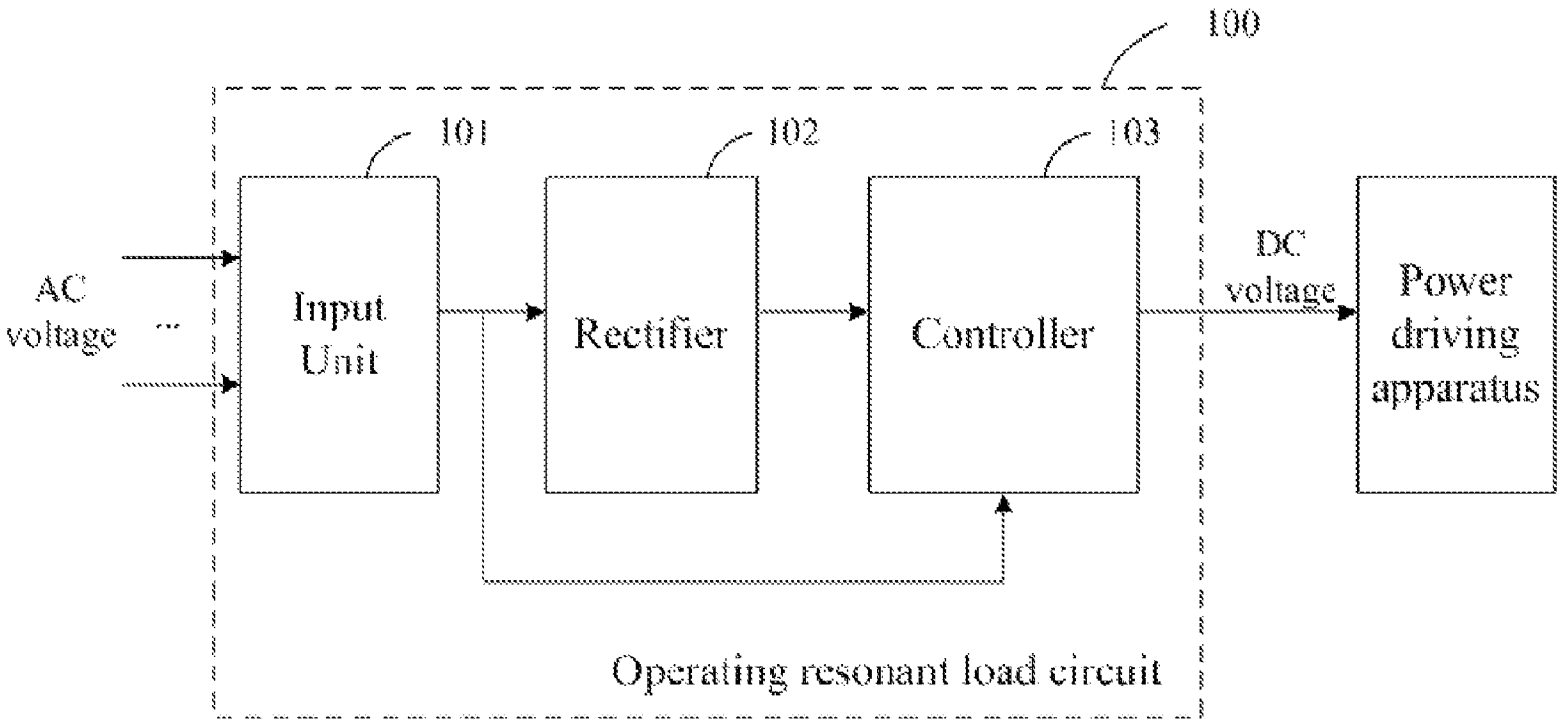
FIG. 1 illustrates a block diagram of an operating resonant load circuit according to an embodiment of the invention.

FIG. 1 illustrates a block diagram of an operating resonant load circuit according to an embodiment of the invention. As shown in FIG. 1, an operating resonant load circuit 100 includes an input unit 101, a rectifier 102 and a controller 103.

The input unit 101 includes multiple terminals for receiving an AC voltage from the external of the operating resonant load circuit. The rectifier 102 is used for transforming the AC voltage received by the input unit into a DC bus voltage. The controller 103 is used for dividing the DC bus voltage based on a conducting status of the input terminals to output a corresponding DC reference voltage.

In an embodiment, the input unit 101 may include three input terminals. The input terminals are used for connecting three output terminals of a three way switch (not shown) respectively. The three way switch may be connected between an external AC voltage source and the input unit 101. The conducting status of the input terminals may be controlled through three different settings of the three way switch, so that the AC voltage can be received by the input unit 101 in three different ways, which will be described hereinafter.

In another embodiment, the input unit 101 may include more input terminals, and the conducting status of these input terminals can be controlled for example by a multi-way switch.

Moreover, as shown in FIG. 1, the operating resonant load circuit 100 may be used together with a power driving apparatus to form a dimming circuit. The power driving apparatus may be implemented using an electronic device available on the market, e.g. an Integrated Circuit (IC), with an inherent function of outputting a driving signal of a corresponding frequency in response to an input changing DC reference voltage. In general, such a power driving IC has a dimming pin, Dim, and receives the DC reference voltage at the Dim pin. Peripheral circuits required by this kind of electronic device are well known in the art.

A main difference between the exemplary embodiments illustrated in FIG. 2 to FIG. 5 lies in that the structure and the arrangement of the control circuits are different. Besides, the structure and the arrangement of the rectifier circuits are slightly different. It should be noted that, in all the exemplary embodiments, the power driving IC shall have the function of outputting a driving signal of a corresponding frequency by inputting a changing DC reference voltage. In addition, only some key pins of the power driving IC relating to the invention are described and shown in the description and the figures.

Figure 2:
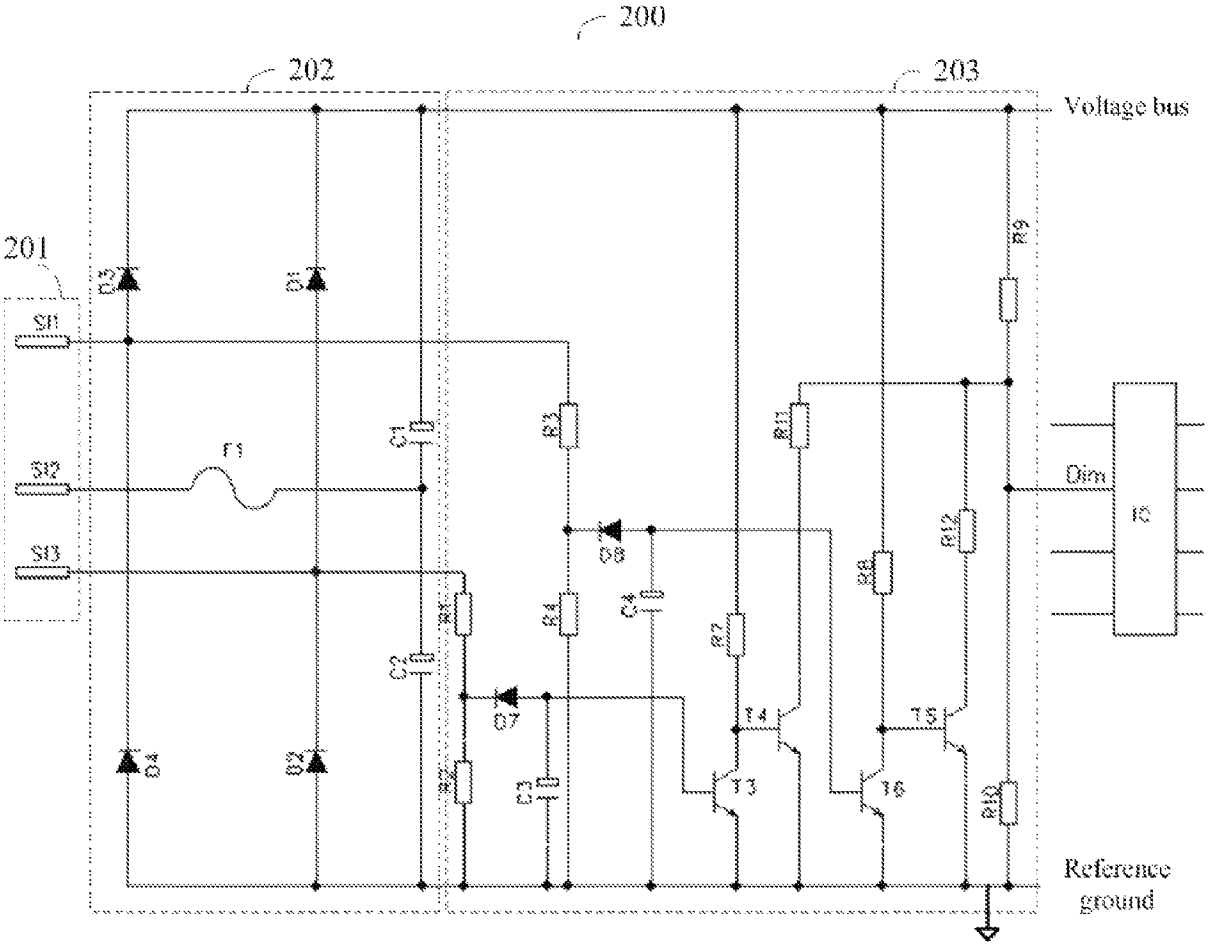
FIG. 2 illustrates a circuit diagram of an operating resonant load circuit according to a first embodiment of the invention.

FIG. 2 illustrates a circuit diagram of an operating resonant load circuit according to a first embodiment of the invention. Operating in cooperation with a three way switch (not shown), an operating resonant load circuit 200 adjusts the power output of a load to three discrete levels corresponding to three settings of the three way switch.

In the operating resonant load circuit 200, SI1, SI2 and SI3 form an input unit 201 of the circuit. Three outputs of a traditional three way switch may be connected to SI1, SI2 and SI3 respectively, so that SI1, SI2 and SI3 can work in cooperation in three different ways through three settings of the three way switch.

The first way is to connect SI3 and SI2 to two output ends of an AC source respectively and make SI1 open through a first setting of the three way switch.

The second way is to connect SI1 and SI2 to two output ends of an AC source respectively and make SI3 open through a second setting of the three way switch.

The third way is to connect both SI1 and SI3 to one of two output ends of an AC source and connect SI2 to the other of the two output ends of the AC source through a third setting of the three way switch.

A branch of transistors D1 and D2 connected in series in the same direction, a branch of transistors D3 and D4 connected in series in the same direction, and a branch of capacitors C1 and C2 connected in series in the same direction are connected in parallel between a voltage bus and a reference ground, thereby forming a double voltage rectifier 202. SI1 is connected to a node between D3 and D4, SI2 is connected to a node between C1 and C2, and SI3 is connected to a node between D1 and D2. The double voltage rectifier 202 transforms an AC input voltage from the input terminals SI1, SI2 and SI3 into a DC voltage and outputs it to the voltage bus.

In a control circuit 203, resistors R1 and R2 connected in series form a voltage network connected to SI3. The cathode of a Zener diode D7 is connected to an intermediate node of the voltage network formed by R1 and R2, and the anode of D7 is connected to the base of a transistor T3. D7 may be used for filtering out some interfering voltages. A capacitor C3 is connected between the base of T3 and the reference ground. The emitter of T3 is connected to the reference ground, and the collector of T3 is connected to the base of a transistor T4. A resistor R7 is connected between the base of T4 and the voltage bus. The emitter of T3 is connected to the reference ground, and the collector of T4 is connected to a resistor R11. The other end of the resistor R11 is connected to a dimming pin of a power driving IC.

R3 and R4 connected in series form a voltage network connected to SI1. The cathode of a Zener diode D8 is connected to an intermediate node of the voltage network formed by R3 and R4, and the anode of D8 is connected to the base of a transistor T6. D8 may be used for filtering out some interfering voltages. A capacitor C4 is connected between the base of T6 and the reference ground. The emitter of T6 is connected to the reference ground, and the collector of T6 is connected to the base of a transistor T5. A resistor R8 is connected between the base of T5 and the voltage bus. The emitter of T5 is connected to the reference ground, and the collector of T5 is connected to a resistor R12. The other end of the resistor R12 is connected to the dimming pin of the power driving IC.

Those skilled in the art shall understand that in the control circuit 203, R11 may also be connected between the emitter of T4 and the reference ground, and R12 may also be connected between the emitter of T5 and the reference ground. However, such an arrangement may increase the required potentials of the bases of the transistor T4 and T5, which may causes inconvenience of circuit adjustment.

Resistors R9 and R10 connected in series between the voltage bus and the reference ground form a voltage network, and an intermediate node of the voltage network is connected to the dimming pin of the power driving IC.

In the control circuit 203, the voltage network formed by R3 and R4, R12 and T5 connected in series between an intermediate node of the voltage network formed by R9 and R10 and the reference ground, and R8 and T6 connected in series between the voltage bus and the reference ground form a first control branch. The first control branch may further include D8 connected between the intermediate node of the voltage network formed by R3 and R4 and the base of T6, and C4 connected between the base of T6 and the reference ground.

Similarly, the voltage network formed by R1 and R2, R11 and T4 connected in series between an intermediate node of the voltage network formed by R9 and R10 and the reference ground, and R7 and T3 connected in series between the voltage bus and the reference ground form a second control branch. The second control branch may further include D7 connected between the intermediate node of the voltage network formed by R1 and R2 and the base of T3, and C3 connected between the base of T3 and the reference ground.

Those skilled in the art shall understand that more input terminals and more control branches may be provided according to actual needs, so as to provide a DC reference voltage having more levels. This principle is also applicable in the following embodiments.

For example, the input unit may include another input terminal. Accordingly, the control circuit 203 may include another control branch. Similar to the above first and second control branches, the another control branch may include: another voltage network connected between the another input terminal of the input unit 201 and the reference ground, another first resistor and another first transistor connected in series between an intermediate node of the voltage network formed by R9 and R10 and the reference ground, and another second resistor and another second transistor connected in series between the voltage bus and the reference ground. The base of the another second transistor is connected to an intermediate node of the another voltage network. The another control branch may further include another Zener diode connected between the intermediate node of the another voltage network and the base of the another second transistor, and another capacitor connected between the base of the another second transistor and the reference ground.

When the input terminals SI1, SI2 and SI3 work in cooperation with each other in the first way, the voltage network formed by R1 and R2 in the operating resonant load circuit 200 can sense an input voltage of SI3, and drive the base of T3 via D7, making T3 saturated (i.e. completely on). The collector of T3 is connected to the base of T4, and the emitter of T3 is connected to the reference ground, therefore the "on" state of T3 makes T4 off.

As SI1 is open in the first way, that is, no input voltage is on SI1, therefore there is no voltage driving the base of T6 via D8, which makes T6 off. Meanwhile, a bus voltage drives the base of T5 via R8, making T5 saturated.

Therefore, the bus voltage is divided by the serial connection of R9 and the parallel connection of R12 and R10, so that a DC reference voltage of the dimming pin of the power driving IC is V11, and the output power of the load is P11.

When the input terminals SI1, SI2 and SI3 work in cooperation with each other in the second way, the voltage network formed by R3 and R4 in the operating resonant load circuit 200 can sense an input voltage of SI1, and drive the base of T6 via D8, making T6 saturated (i.e. completely on). The collector of T6 is connected to the base of T5, and the emitter of T6 is connected to the reference ground, therefore the "on" state of T6 makes T5 off.

As SI3 is open in the second way, that is, no input voltage is on SI3, therefore there is no voltage driving the base of T3 via D7, which makes T3 off. Meanwhile, the bus voltage drives the base of T4 via R7, making T4 saturated.

Therefore, the bus voltage is divided by the serial connection of R9 and the parallel connection of R11 and R10, so that a DC reference voltage of the dimming pin of the power driving IC is V12, and the output power of the load is P12.

When the input terminals SI1, SI2 and SI3 work in cooperation with each other in the third way, the voltage network formed by R3 and R4 in the operating resonant load circuit 200 can sense an input voltage of SI1, and drive the base of T6 via D8, which makes T6 saturated and further makes T5 off. Meanwhile, the voltage network formed by R1 and R2 in the operating resonant load circuit 200 can sense an input voltage of SI3, and drive the base of T3 via D7, which makes T3 saturated and further makes T4 off.

Therefore, the bus voltage is divided by the serial connection of R9 and R10, so that a DC reference voltage of the dimming pin of the power driving IC is V13, and the output power of the load is P13.

In practice, considering the user experience, the resistance of the resistor R11 is generally set to be larger than that of the resistor R12. Therefore, when the input terminals SI1, SI2 and SI3 are made to work in cooperation with each other sequentially in the first, the second and the third ways, DC reference voltages from lower to higher can be provided to the power driving IC by the operating resonant load circuit 200 illustrated in FIG. 2, so that the power of the load drove by the power driving IC, e.g. the brightness of a lamp, can change e.g. from darker to brighter, or from brighter to darker. Apparently, here it is not intended to limit the resistances of R11 and R12, which can be any applicable values according to needs.

In addition, in practice, the operating resonant load circuit 200 is suitable for a 120V AC input, and the third setting of the three way switch corresponds to the maximum load power output.

Figure 3:
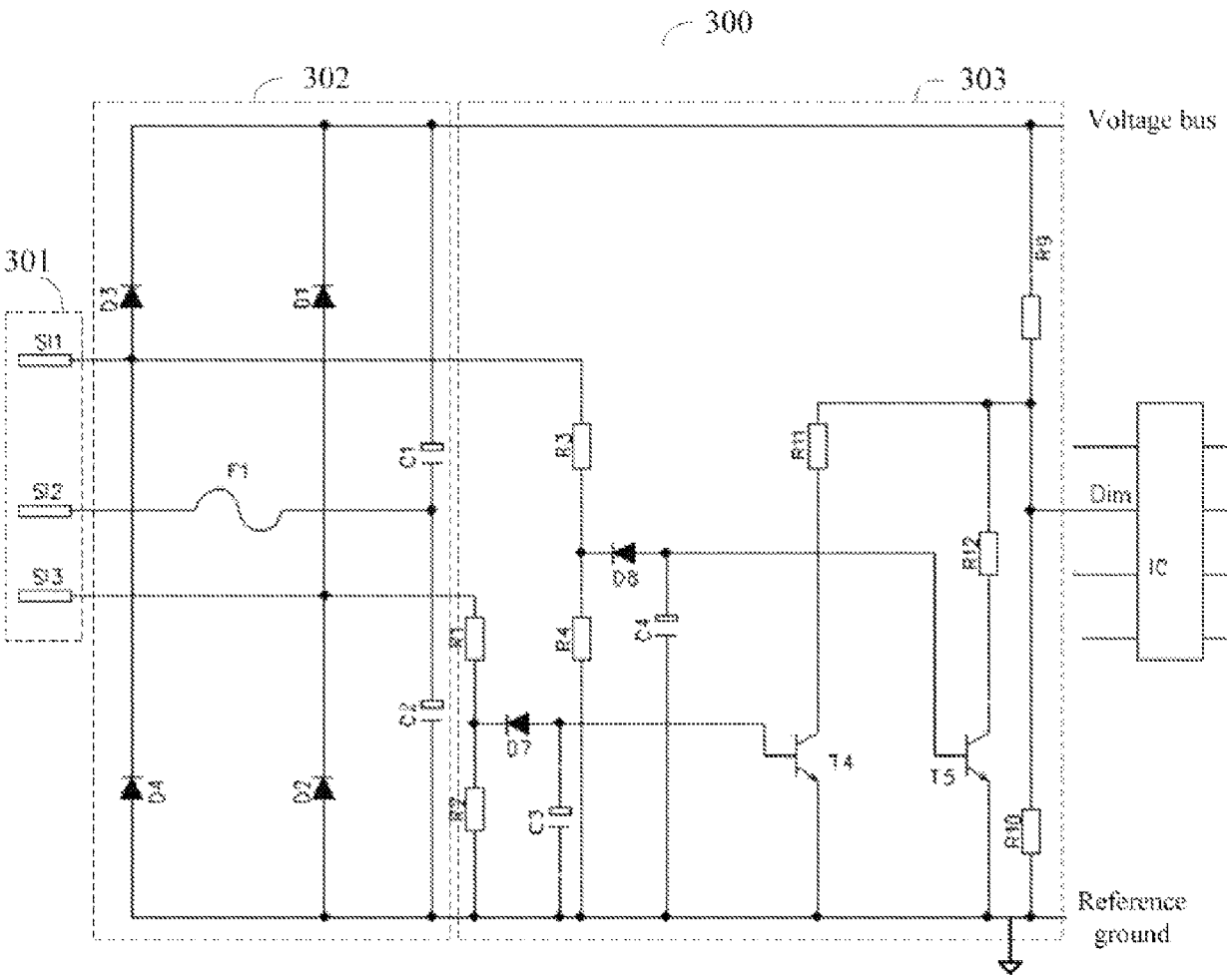
FIG. 3 illustrates a circuit diagram of an operating resonant load circuit according to a second embodiment of the invention.

FIG. 3 illustrates a circuit diagram of an operating resonant load circuit according to a second embodiment of the invention. Operating in cooperation with a three way switch (not shown), an operating resonant load circuit 300 adjusts the power output of a load to three discrete levels corresponding to three settings of the three way switch.

In the operating resonant load circuit 300, input terminals SI1, SI2 and SI3 form an input unit 301 of the circuit. Three outputs of a traditional three way switch may be connected to SI1, SI2 and SI3 respectively, so that SI1, SI2 and SI3 can work in cooperation with each other in three different ways. Descriptions for the three different ways are not repeated here because they have been described with the description of FIG. 2.

In the operating resonant load circuit 300, a double voltage rectifier 302 has a structure and connections with other components the same as the double voltage rectifier 202 of the operating resonant load circuit 300 in the first embodiment illustrated in FIG. 2, the descriptions of which are thus not repeated here.

In a control circuit 303, resistors R1 and R2 connected in series form a voltage network connected to SI3. The cathode of a Zener diode D7 is connected to an intermediate node of the voltage network formed by R1 and R2, and the anode of D7 is connected to the base of a transistor T4. D7 may be used for filtering out some interfering voltages. A capacitor C3 is connected between the base of T4 and the reference ground. The emitter of T3 is connected to the reference ground, and the collector of T4 is connected to the base of a resistor R11. The other end of a resistor R11 is connected to a dimming pin of a power driving IC.

R3 and R4 connected in series form a voltage network connected to SI1. The cathode of a Zener diode D8 is connected to an intermediate node of the voltage network formed by R3 and R4, and the anode of D8 is connected to the base of a transistor T5. D8 may be used for filtering out some interfering voltages. A capacitor C4 is connected between the base of T5 and the reference ground. The emitter of T5 is connected to the reference ground, and the collector of T5 is connected to a resistor R12. The other end of the resistor R12 is connected to the dimming pin of the power driving IC.

Those skilled in the art shall understand that in the control circuit 303, R11 may also be connected between the emitter of T4 and the reference ground, and R12 may also be connected between the emitter of T5 and the reference ground. However, such an arrangement may increase the required potentials of the bases of the transistor T4 and T5, which may causes inconvenience of circuit adjustment.

Resistors R9 and R10 connected in series between the voltage bus and the reference ground form a voltage network, and an intermediate node of the voltage network is connected to the dimming pin of the power driving IC.

In the control circuit 203, the voltage network formed by R3 and R4 and R12 and T5 connected in series between an intermediate node of the voltage network formed by R9 and R10 and the reference ground form a first control branch. The first control branch may further include D8 connected between the intermediate node of the voltage network formed by R3 and R4 and the base of T6, and C4 connected between the base of T6 and the reference ground.

Similarly, the voltage network formed by R1 and R2 and R11 and T4 connected in series between an intermediate node of the voltage network formed by R9 and R10 and the reference ground form a second control branch. The second control branch may further include D7 connected between the intermediate node of the voltage network formed by R1 and R2 and the base of T3, and C3 connected between the base of T3 and the reference ground.

According to actual needs, the input unit may include another input terminal. Accordingly, the control circuit 303 may include another control branch. Similar to the above first and second control branches, the another control branch may include: another voltage network connected between the another input terminal of the input unit 301 and the reference ground, and another resistor and another transistor connected in series between an intermediate node of the voltage network formed by R9 and R10 and the reference ground. The base of the another transistor is connected to an intermediate node of the another voltage network. The another control branch may further include another Zener diode connected between the intermediate node of the another voltage network and the base of the another second transistor, and another capacitor connected between the base of the another second transistor and the reference ground.

Compared with the operating resonant load circuit 200 illustrated in FIG. 2, the branch formed by the resistor R7 and the transistor T3 and the branch formed by the resistor R8 and the transistor T6 are reduced in the operating resonant load circuit 300.

The cooperative working between the operating resonant load circuit 300 and the three way switch will be described hereinafter.

When the input terminals SI1, SI2 and SI3 work in cooperation with each other in the first way, the voltage network formed by R1 and R2 in the operating resonant load circuit 300 can sense an input voltage of SI3, and drive the base of T4 via D7, making T4 saturated (i.e. completely on).

As SI1 is open in the first way, that is, no input voltage is on SI1, therefore there is no voltage driving the base of T5 via D8, which makes T5 off.

Therefore, the bus voltage is divided by the serial connection of R9 and the parallel connection of R11 and R10, so that a DC reference voltage of the dimming pin of the power driving IC is V21, and the output power of the load is P21.

When the input terminals SI1, SI2 and SI3 work in cooperation with each other in the second way, the voltage network formed by R3 and R4 in the operating resonant load circuit 300 can sense an input voltage of SI1, and drive the base of T5 via D8, making T5 saturated (i.e. completely on).

As SI3 is open in the second way, that is, no input voltage is on SI3, therefore there is no voltage driving the base of T4 via D7, which makes T4 off.

Therefore, the bus voltage is divided by the serial connection of R9 and the parallel connection of R12 and R10, so that a DC reference voltage of the dimming pin of the power driving IC is V22, and the output power of the load is P22.

When the input terminals SI1, SI2 and SI3 work in cooperation with each other in the third way, the voltage network formed by R3 and R4 in the operating resonant load circuit 300 can sense an input voltage of SI1, and drive the base of T5 via D8, which makes T5 saturated. Meanwhile, the voltage network formed by R1 and R2 in the operating resonant load circuit 300 can sense an input voltage of SI3, and drive the base of T4 via D7, which makes T4 saturated.

Therefore, the bus voltage is divided by the serial connection of R9 and the parallel connection of R11, R12 and R10, so that a DC reference voltage of the dimming pin of the power driving IC is V23, and the output power of the load is P23.

In practice, considering the user experience, the resistance of the resistor R11 is generally set to be larger than the one of the resistor R12. Therefore, when the input terminals SI1, SI2 and SI3 are made to work in cooperation with each other sequentially in the first, the second and the third ways, DC reference voltages from higher to lower can be provided to the power driving IC by the operating resonant load circuit 300 illustrated in FIG. 3, so that the power of the load drove by the power driving IC, e.g. the brightness of a lamp, can change e.g. from brighter to darker, or from darker to brighter. Apparently, here it is not intended to limit the resistances of R11 and R12, which can be any applicable values according to needs.

In addition, in practice, the operating resonant load circuit 300 is suitable for a 120V AC input, and the third setting of the three way switch corresponds to the minimum load power output.

Figure 4:
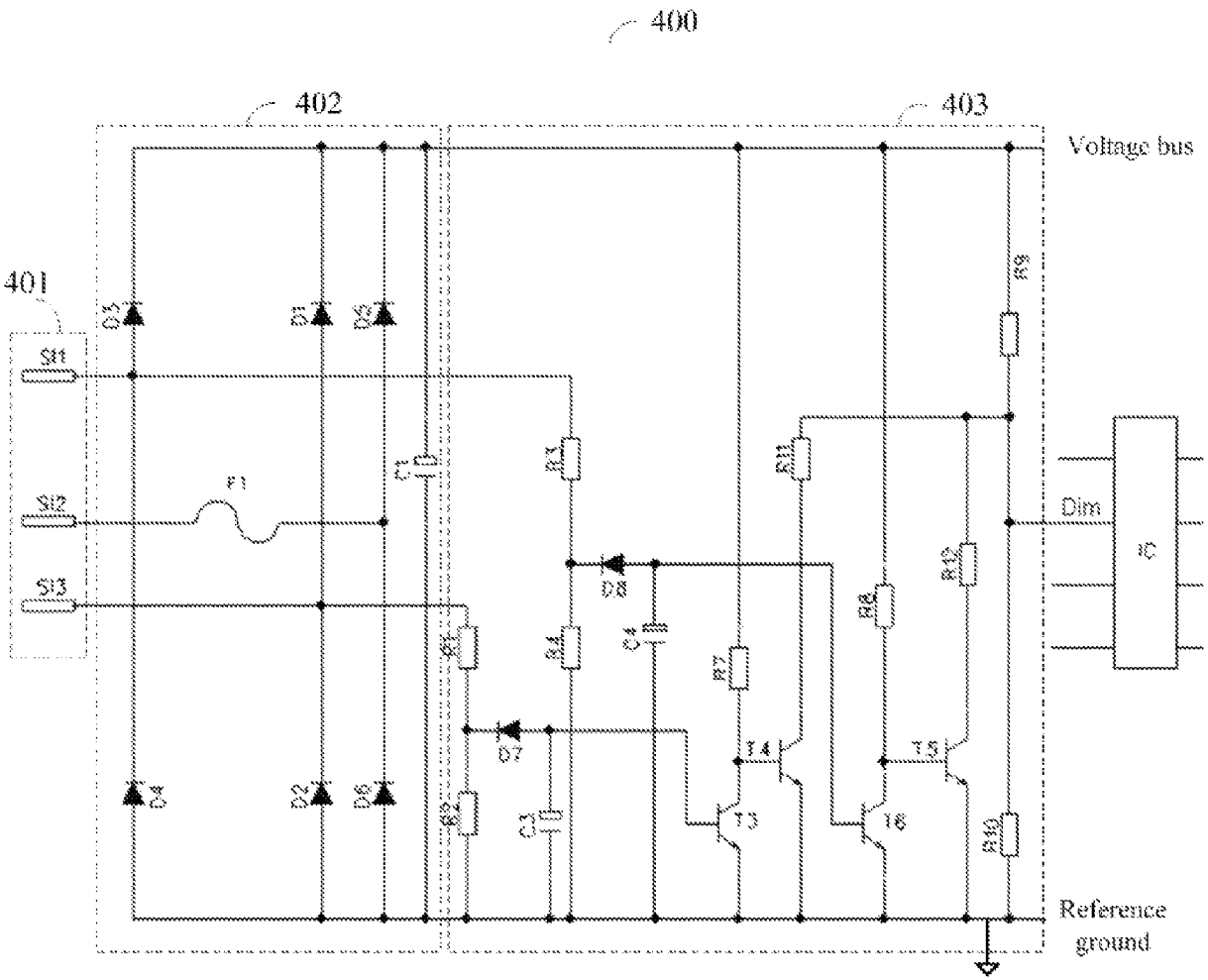
FIG. 4 illustrates a circuit diagram of an operating resonant load circuit according to a third embodiment of the invention.

FIG. 4 illustrates a circuit diagram of an operating resonant load circuit according to a third embodiment of the invention. Operating in cooperation with a three way switch (not shown), an operating resonant load circuit 400 adjusts the power output of a load to three discrete levels corresponding to three settings of the three way switch.

In the operating resonant load circuit 400, input terminals SI1, SI2 and SI3 form an input unit 401 of the circuit. Three outputs of a traditional three way switch may be connected to SI1, SI2 and SI3 respectively, so that SI1, SI2 and SI3 can work in cooperation with each other in three different ways. Descriptions for the three different ways are not repeated here because they have been described with the description of FIG. 2.

A branch of transistors D1 and D2 connected in series in the same direction, a branch of transistors D3 and D4 connected in series in the same direction, a branch of transistors D5 and D6 connected in series in the same direction, and a capacitor C1 are connected in parallel between a voltage bus and a reference ground, which forms a rectifier 402. SI1 is connected to a node between D3 and D4, SI2 is connected to a node between D5 and D6, and SI3 is connected to a node between D1 and D2.

Compared with the operating resonant load circuit 200 illustrated in FIG. 2, the rectifier 402 is not a double voltage rectifier. Except for the structure of the rectifier 402 and its connections with the input terminals SI1-SI3, all the other structures, connections and operation principles of the operating resonant load circuit 400 are the same as the operating resonant load circuit 200 illustrated in FIG. 2, the descriptions of which are thus not repeated here.

Similar to the operating resonant load circuit 200 illustrated in FIG. 2, if the resistance of the resistor R11 is larger than that of the resistor R12, when the input terminals SI1, SI2 and SI3 are made to work in cooperation with each other sequentially in the first, the second and the third ways, DC reference voltages from lower to higher can be provided to the power driving IC by the operating resonant load circuit 400 illustrated in FIG. 4. Apparently, here it is not intended to limit the resistances of R11 and R12, which can be any applicable values according to needs.

In addition, because the rectifier 402 is not a double voltage rectifier, in practice the operating resonant load circuit 400 is suitable for both a 120V AC input and a 230V AC input. Furthermore, for operating resonant load circuit 400, the third setting of the three way switch corresponds to the maximum load power output.

FIG. 5 illustrates a circuit diagram of an operating resonant load circuit according to a fourth embodiment of the invention. Operating in cooperation with a three way switch (not shown), an operating resonant load circuit 500 adjusts the power output of a load to three discrete levels corresponding to three settings of the three way switch.

In the operating resonant load circuit 500, input terminals SI1, SI2 and SI3 form an input unit 501 of the circuit. Three outputs of a traditional three way switch may be connected to SI1, SI2 and SI3 respectively, so that SI1, SI2 and SI3 can work in cooperation with each other in three different ways. Descriptions for the three different ways are not repeated here because they have been described with the description of FIG. 2.

In the operating resonant load circuit 500, a double voltage rectifier 502 has a structure and connections with input terminals the same as the double voltage rectifier 402 of the operating resonant load circuit 400 in the third embodiment illustrated in FIG. 4, the descriptions of which are thus not repeated here.

Compared with the operating resonant load circuit 300 illustrated in FIG. 3, the rectifier 502 is not a double voltage rectifier. Except for the structure of the rectifier 502 and its connections with the input terminals SI1-SI3, all the other structures, connections and operation principles of the operating resonant load circuit 500 are the same as the operating resonant load circuit 300 illustrated in FIG. 3, the descriptions of which are thus not repeated here.

Similar to the operating resonant load circuit 300 illustrated in FIG. 3, if the resistance of the resistor R11 is larger than that of the resistor R12, when the input terminals SI1, SI2 and SI3 are made to work in cooperation with each other sequentially in the first, the second and the third ways, DC reference voltages from higher to lower can be provided to the power driving IC by the operating resonant load circuit 500 illustrated in FIG. 5. Apparently, here it is not intended to limit the resistances of R11 and R12, which can be any applicable values according to needs.

In addition, because the rectifier 502 is not a double voltage rectifier, in practice the operating resonant load circuit 500 is suitable for both a 120V AC input and a 230V AC input. Furthermore, for operating resonant load circuit 500, the third setting of the three way switch corresponds to the minimum load power output.

With an operating resonant load circuit according to the above embodiments, a load, e.g. a gas-discharge lamp, can work in three dimming states by means of a three way switch. However, the invention is not limited to use a gas-discharge lamp as the load.

Another embodiment of the invention further provides a dimming method adapted to be used in a dimming circuit according to embodiments of the invention. The dimming method includes: sensing an input voltage of the input unit; determining whether the input voltage is provided at the first input terminal, the second terminal, or both the input terminals of the input unit; generating by the operating resonant circuit a first DC reference voltage in response to the input voltage, if the input voltage is provided only at the first input terminal; generating by the operating resonant circuit a second DC reference voltage in response to the input voltage, if the input voltage is provided only at the second input terminal; generating by the operating resonant circuit a third DC reference voltage in response to the input voltage, if the input voltage is provided at both the input terminals; and applying the first DC reference voltage, the second DC reference voltage or the third DC reference voltage to the power driving apparatus, so as to output a corresponding power level.

It should be noted that, in this description, relational terms such as left and right and first and second are merely for distinguishing one entity or operation from another entity or operation, and do not require or imply that any actual relations or orders exist between these entities or operations. Moreover, the terms "include", "contain" or any alternations are intended to cover non-exclusive inclusion, therefore a process, method, article or device including a series of elements not only includes these elements but also includes other elements that are not explicitly listed, or includes inherent elements of the process, method, article or device. In addition, without further limitation, an element defined with the wording "including a" does not exclude the case where more of the same elements exist in the process, method, article or device that includes the element.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An operating resonant load circuit, comprising:

an input unit including a plurality of input terminals, to receive an Alternating Current (AC) voltage;

a rectifier, to transform the AC voltage received by the input unit into a Direct Current (DC) bus voltage; and a controller, to divide the DC bus voltage based on a conducting status of the input terminals to output a corresponding DC reference voltage, wherein the controller comprises:

a first voltage network, connected between a voltage bus and a reference ground of the circuit;

a first control branch, comprising a second voltage network connected between a first input terminal of the input unit and the reference ground, and a first resistor and a first transistor connected in series between an intermediate node of the first voltage network and the reference ground, a base of the first transistor being connected to an intermediate node of the second voltage network; and a second control branch, comprising a third voltage network connected between a second input terminal of the input unit and the reference ground, and a second resistor and a second transistor connected in series between the intermediate node of the first voltage network and the reference ground, a base of the second transistor being connected to an intermediate node of the third voltage network.

2. The operating resonant load circuit of claim 1, wherein the controller further comprises another control branch, the another control branch comprising: another voltage network connected between another input terminal of the input unit and the reference ground, and another resistor and another transistor connected in series between the intermediate node of the first voltage network, a base of the another transistor being connected to an intermediate node of the another voltage network.

3. The operating resonant load circuit of claim 1, wherein the base of the first transistor is connected to the intermediate node of the second voltage network via a first Zener diode, and the base of the second transistor is connected to the intermediate node of the third voltage network via a second Zener diode.

4. The operating resonant load circuit of claim 1, wherein the first control branch of the controller further comprises a third resistor and a third transistor connected in series between the voltage bus and the reference ground, the base of the first transistor being connected to a collector of the third transistor instead of the base of the first transistor being connected to the intermediate node of the second voltage network, and a base of the third transistor being connected to the intermediate node of the second voltage network; and the second control branch further comprises a fourth resistor and a fourth transistor connected in series between the voltage bus and the reference ground, the base of the second transistor being connected to a collector of the fourth transistor instead of the base of the second transistor being connected to the intermediate node of the third voltage network, and a base of the third transistor being connected to the intermediate node of the third voltage network.

5. The operating resonant load circuit of claim 1, wherein the rectifier is connected between the voltage bus of the circuit and the reference ground.

6. The operating resonant load circuit of claim 1, wherein the rectifier comprises:

a first diode and a second diode connected in series in the same direction between the voltage bus and the reference ground;

a third diode and a fourth diode connected in series in the same direction between the voltage bus and the reference ground; and a first capacitor and a second capacitor connected in series in the same direction between the voltage bus and the reference ground;

wherein the pair of the first diode and the second diode, the pair of the third diode and the fourth diode, and the pair of the first capacitor and the second capacitor are connected in parallel.

7. The operating resonant load circuit of claim 6, wherein the first input terminal of the input unit is connected to a node between the first diode and the second diode, the second input terminal of the input unit is connected to a node between the third diode and the fourth diode, and a third input terminal of the input unit is connected to a node between the first capacitor and the second capacitor.

8. The operating resonant load circuit of claim 1, wherein the rectifier comprises:

a first diode and a second diode connected in series in the same direction between the voltage bus and the reference ground;

a third diode and a fourth diode connected in series in the same direction between the voltage bus and the reference ground; and a first capacitor and a second capacitor connected in series in the same direction between the voltage bus and the reference ground;

wherein the pair of the first diode and the second diode, the pair of the third diode and the fourth diode, and the pair of the first capacitor and the second capacitor are connected in parallel.

9. The operating resonant load circuit of claim 8, wherein the first input terminal of the input unit is connected to a node between the first diode and the second diode, the second input terminal of the input unit is connected to a node between the third diode and the fourth diode, and a third input terminal of the input unit is connected to a node between the first capacitor and the second capacitor.

10. The operating resonant load circuit of claim 1, wherein the rectifier comprises:

a first diode and a second diode connected in series in the same direction between the voltage bus and the reference ground;

a third diode and a fourth diode connected in series in the same direction between the voltage bus and the reference ground;

a fifth diode and a sixth diode connected in series in the same direction between the voltage bus and the reference ground; and a first capacitor connected between the voltage bus and the reference ground;

wherein the pair of the first diode and the second diode, the pair of the third diode and the fourth diode, the pair of the fifth diode and the sixth diode, and the first capacitor are connected in parallel.

11. The operating resonant load circuit of claim 10, wherein the first input terminal of the input unit is connected to a node between the first diode and the second diode, the second input terminal of the input unit is connected to a node between the third diode and the fourth diode, and a third input terminal of the input unit is connected to a node between the fifth diode and the sixth diode.

12. The operating resonant load circuit of claim 1, wherein the rectifier comprises:

a first diode and a second diode connected in series in the same direction between the voltage bus and the reference ground;

a third diode and a fourth diode connected in series in the same direction between the voltage bus and the reference ground;

a fifth diode and a sixth diode connected in series in the same direction between the voltage bus and the reference ground; and a first capacitor connected between the voltage bus and the reference ground;

wherein the pair of the first diode and the second diode, the pair of the third diode and the fourth diode, the pair of the fifth diode and the sixth diode, and the first capacitor are connected in parallel.

13. The operating resonant load circuit of claim 12, wherein the first input terminal of the input unit is connected to a node between the first diode and the second diode, the second input terminal of the input unit is connected to a node between the third diode and the fourth diode, and a third input terminal of the input unit is connected to a node between the fifth diode and the sixth diode.

14. A dimming circuit, comprising:

an operating resonant load circuit, wherein the operating resonant load circuit comprises:

an input unit including a plurality of input terminals, to receive an Alternating Current (AC) voltage;

a rectifier, to transform the AC voltage received by the input unit into a Direct Current (DC) bus voltage; and a controller, to divide the DC bus voltage based on a conducting status of the input terminals to output a corresponding DC reference voltage, wherein the controller comprises:

a first voltage network, connected between a voltage bus and a reference ground of the circuit;

a first control branch, comprising a second voltage network connected between a first input terminal of the input unit and the reference ground, and a first resistor and a first transistor connected in series between an intermediate node of the first voltage network and the reference ground, a base of the first transistor being connected to an intermediate node of the second voltage network; and a second control branch, comprising a third voltage network connected between a second input terminal of the input unit and the reference ground, and a second resistor and a second transistor connected in series between the intermediate node of the first voltage network and the reference ground, a base of the second transistor being connected to an intermediate node of the third voltage network; and a power driving apparatus, to receive a DC reference voltage from the operating resonant load circuit and to output a driving signal of a corresponding frequency based on the received DC reference voltage.

15. The dimming circuit of claim 14, wherein the rectifier comprises:

a first diode and a second diode connected in series in the same direction between the voltage bus and the reference ground;

a third diode and a fourth diode connected in series in the same direction between the voltage bus and the reference ground; and a first capacitor and a second capacitor connected in series in the same direction between the voltage bus and the reference ground;

wherein the pair of the first diode and the second diode, the pair of the third diode and the fourth diode, and the pair of the first capacitor and the second capacitor are connected in parallel.

16. The dimming circuit of claim 14, wherein the rectifier comprises:

a first diode and a second diode connected in series in the same direction between the voltage bus and the reference ground;

a third diode and a fourth diode connected in series in the same direction between the voltage bus and the reference ground;

a fifth diode and a sixth diode connected in series in the same direction between the voltage bus and the reference ground; and a first capacitor connected between the voltage bus and the reference ground;

wherein the pair of the first diode and the second diode, the pair of the third diode and the fourth diode, the pair of the fifth diode and the sixth diode, and the first capacitor are connected in parallel.

17. A method of dimming comprising:

sensing an input voltage of an input unit;

determining whether the input voltage is provided at a first input terminal, a second terminal, or both input terminals of the input unit;

generating, by an operating resonant circuit, a corresponding voltage in response to the input voltage, wherein the corresponding voltage is based on the determined terminal or terminals of the input unit at which the input voltage is provided, wherein generating comprises:

generating, by an operating resonant circuit, a corresponding voltage in response to the input voltage, wherein the corresponding voltage is based on the determined terminal or terminals of the input unit at which the input voltage is provided, such that:

the corresponding voltage is a first DC reference voltage when the determined terminal or terminals is only the first input terminal;

the corresponding voltage is a second DC reference voltage when the determined terminal or terminals is only the second input terminal; and the corresponding voltage is a third DC reference voltage when the determined terminal or terminals is both the input terminals; and applying the corresponding voltage to a power driving apparatus, so as to output a corresponding power level, wherein applying comprises:

applying the first DC reference voltage, the second DC reference voltage or the third DC reference voltage to a power driving apparatus, so as to output a corresponding power level.

* * * * *